United States Patent [19]

Pickler

[11] Patent Number: 4,913,301

[45] Date of Patent: Apr. 3, 1990

[54] REFUSE CONTAINER

[76] Inventor: Nathan L. Pickler, P.O. Box 528, Spencer, N.C. 28159

[21] Appl. No.: 245,579

[22] Filed: Sep. 19, 1988

[51] Int. Cl.[4] ..... B65D 25/00

[52] U.S. Cl. ..... 220/1 T; 220/4 A

[58] Field of Search ..... 220/1 T, 4 A

[56] References Cited

U.S. PATENT DOCUMENTS

| | | | |
|---|---|---|---|
| 3,883,005 | 5/1975 | Stevens | 220/4 A X |
| 4,186,844 | 2/1980 | Swanson | 220/1 T X |
| 4,335,828 | 6/1982 | Robinson et al. | 220/1 T X |
| 4,538,512 | 9/1985 | Blough | 220/1 T X |
| 4,609,117 | 9/1986 | Pamment | 220/1 T |
| 4,615,454 | 10/1986 | Verhoog, Jr. | 220/1 T X |
| 4,722,270 | 2/1988 | Wall | 220/1 T X |

*Primary Examiner*—Steven M. Pollard

*Attorney, Agent, or Firm*—Donald L. Weinhold, Jr.

[57] ABSTRACT

An improved receptacle for solid waste, trash, garbage, and discarded materials, commonly known as a "dumpster" generally recognized for commercial or extraordinary utility. The invention utilizes a standard body component which serves as a base unit for manufacture of all commercial sizes and which may be enlarged by the addition of extension members which increase volume. The invention is designed to be manufactured in reenforceable components to permit nesting for ease of transportation. Additionally, the invention is designed for the clean dumping into a compactor truck or other collection device without being submerged into the compactor. The invention is also designed to facilitate the dumping process, improve the routine maintenance demands and produce a more durable receptacle as will be more specifically show in the accompany specification.

19 Claims, 8 Drawing Sheets

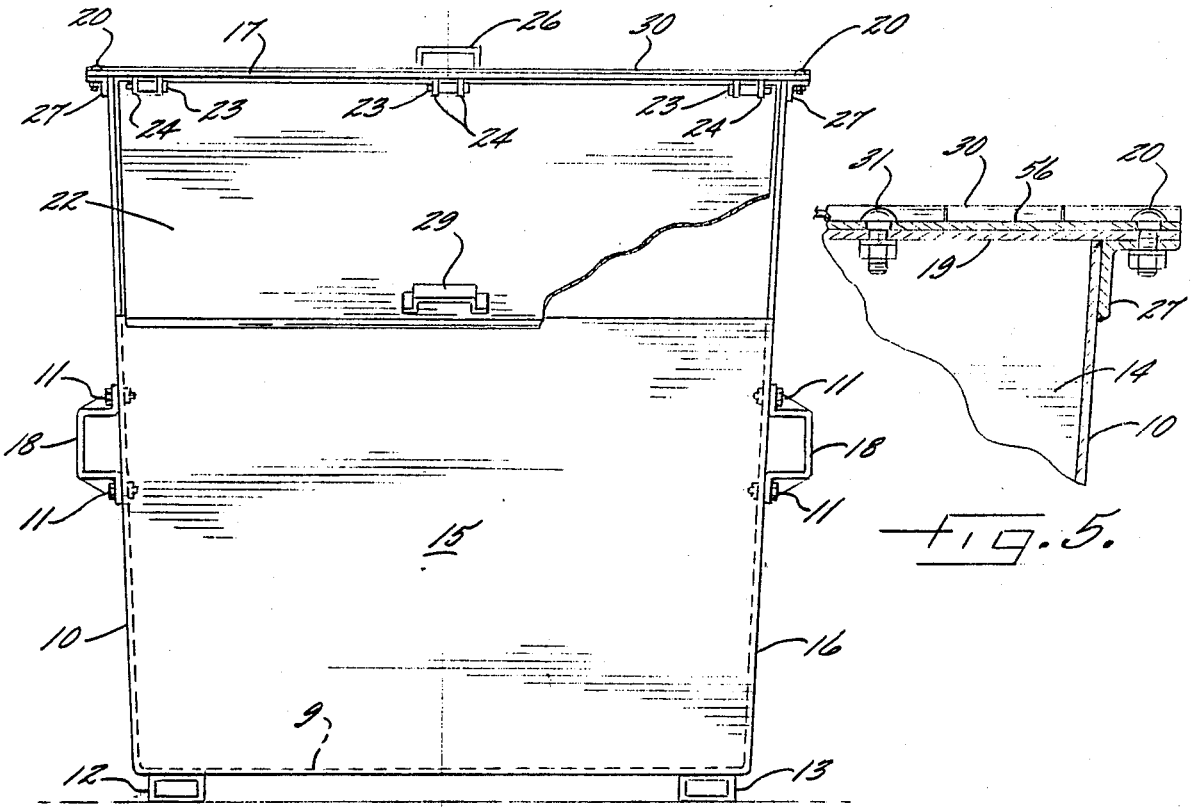
FIG. 3.
FIG. 5.
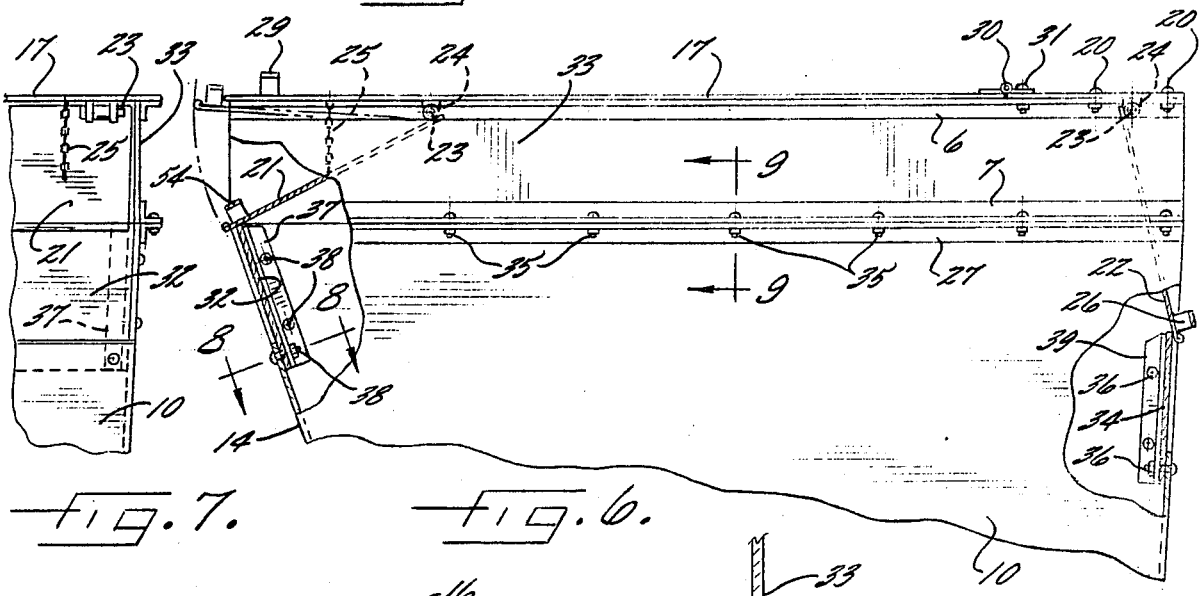
FIG. 7.
FIG. 6.
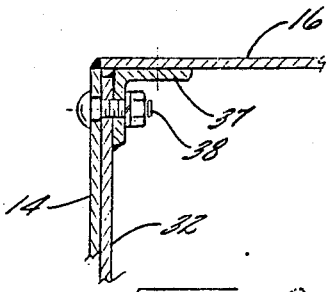
FIG. 8.
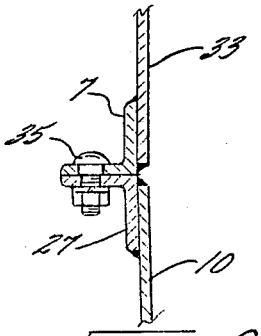
FIG. 9.

REFUSE CONTAINER

BACKGROUND OF THE INVENTION

The use of large bin-type garbage receptacles for commercial, industrial and extraordinary solid waste producers has become not only commonplace but indispensable to efficient sanitation control. Receptacles generally referred to as 'dumpsters' are placed at strategic locations throughout sanitation districts across the country. Part of their popularity arises from the fact that they can hold large quantities of refuse and can be dumped at the site of collection, the refuse collected in a compacting vehicle, and can be transported to a landfill, incinerator or other disposal location for final deposit.

The frequency of disposal depends on the frequency of use and the size of the container. Limiting factors include size of the receptacle, the ease of dumping and the type of refuse being deposited. The 'dumpster'-type receptacle has been standardized in design to accommodate certain types of compacting vehicles which are generally equipped with hydraulic lifters which facilitate the lifting and dumping action which is used to empty the receptacle.

The present design of dumpster generally includes perpendicular walls, various doors on multiple sides, generally open tops, and standard sizes. When a consumer needs a receptacle, a decision must be made as to which size is most desirable. Because the receptacles are made of heavy gauge steel, they are quite expensive. Consequently, choosing the wrong size container or subsequently outgrowing the size previously purchased is also quite expensive.

Another characteristic of the 'dumpsters' presently in use, is that because they are inherently heavy and bulky in design, they are extremely expensive to transport from the manufacturer to the consumer.

SUMMARY OF THE INVENTION

The present invention has been designed and engineered to overcome many disadvantages of the present state of the art. The instant invention utilizes a standardized body which may be mass produced of a standard size, representing an optimal size for lower level usage, such as small schools and cafes.

Basic design includes many novel features such as removeable lifting sleeves and tapered walls to facilitate clean dumping removal and stackability which enables transportation of many units simultaneously. In addition, lifting sleeves, which are longer for additional support and control, are placed flush with the front wall to facilitate controlled dumping action. Rather than using the conventional dumping action through which the container being dumped is partially introduced into the compactor hopper, the container of the present invention is designed to permit a dumping action in which the container being dumped remains removed from the compactor hopper while permitting dumped refuse to follow a chute into the compactor hopper leaving more room in the hopper for refuse. A more efficient and cleaner operation can be thus expected.

In addition, a drain is provided in the bottom surface of the container in order to drain liquid waste from the container keeping it cleaner and expanding the life of the container. Also, the container is designed to resist entry and accumulation of rain water, further preserving the expected lifetime of the container. The slight taper of the walls with a predominant taper of the front wall, smooth internal surfaces and dumping simultaneously through the front wall and top of the container guarantees a smoother operation, cleaner dumpster, less strain on the side walls and sleeve, lower maintenance costs and longer life.

As a major object of this invention, standardized extension units may be added to the standardized body element to increase its volume to accommodate larger usages without the necessity to replace the entire unit, at a fraction of the cost.

It is therefore an object of the present invention to provide an improved refuse container which may be mass produced in standardized units, producing a simple, low cost, low maintenance garbage bin applicable to industrial, commercial, and residential locations.

It is a further object of my invention to provide a container for refuse which is more efficient and more durable than conventional containers.

Yet another object of my invention is to produce a more economical refuse compactor design from the manufacture and shipping standpoint.

Other objects and advantages of the present invention will become apparent to those skilled in the art after considering the following specification which discloses referred embodiment thereof in conjunction with the accompanying drawings, wherein:

BRIEF DESCRIPTION OF THE DRAWINGS

FIG. 3 is a rear elevational view of the standard body configuration of my present invention.

FIG. 5 is a detail view taken along section 5—5 of FIG. 1.

FIG. 6 is a right side elevational view of the second embodiment showing the extension element of the standard body.

FIG. 7 is a detail elevational section of the second embodiment showing the extension element along the right top corner of the front of my invention.

FIG. 8 is a detail view taken along section 8—8 of FIG. 6.

FIG. 9 is a detail view taken along section 9—9 of FIG. 6.

FIG. 1O is a side elevational view showing the first and second embodiments of my present invention as shown in the dump position with a conventional compactor.

DETAILED DESCRIPTION OF THE DRAWINGS

Figure 1:
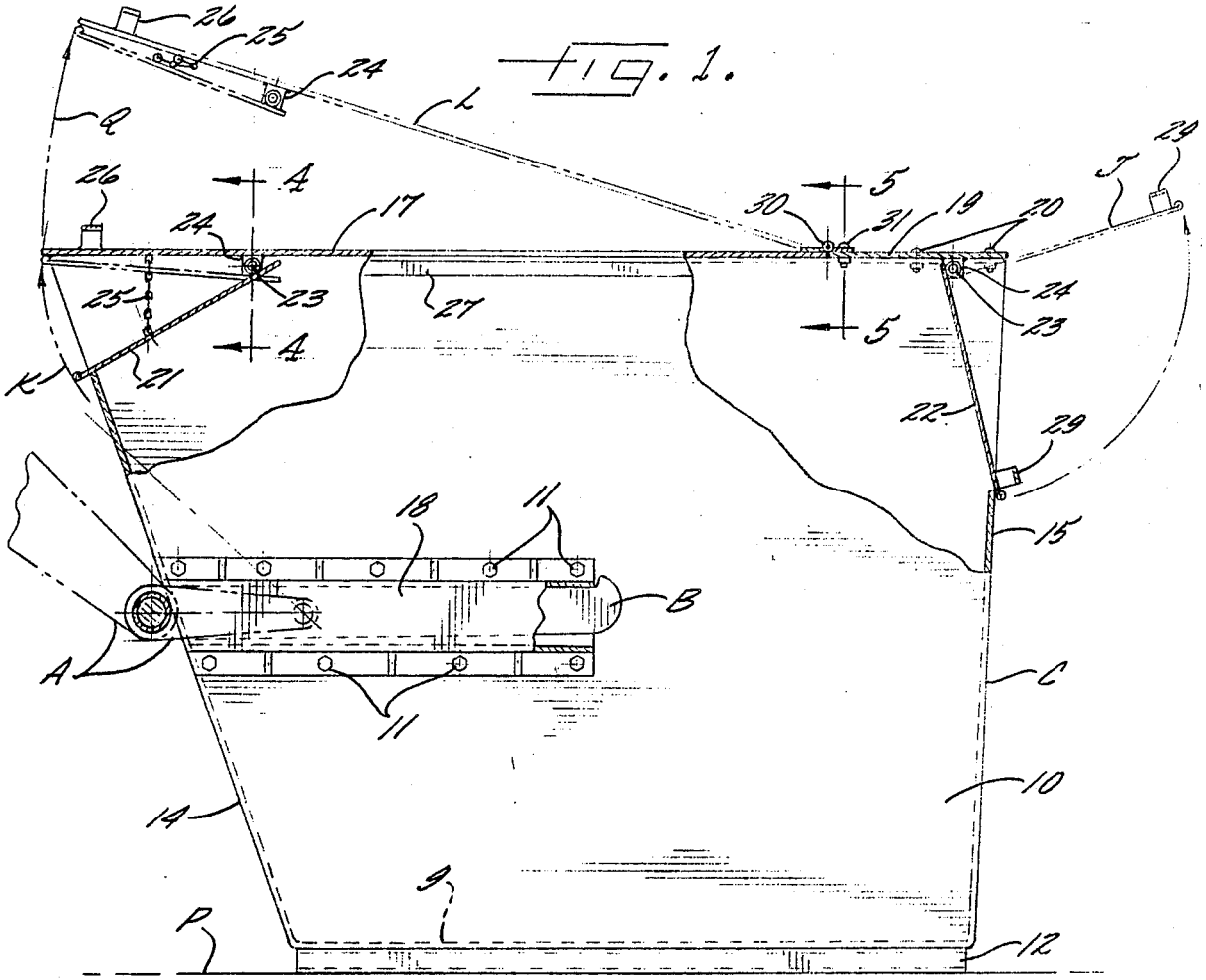
FIG. 1 is right side elevational view of the standard body configuration of the first embodiment of my present invention.
Figure 2:
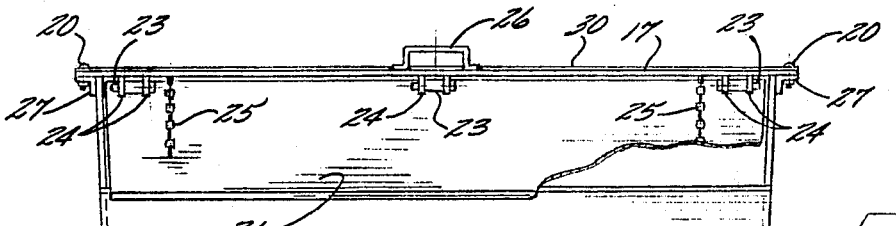
FIG. 2 is a front elevational view of the standard body configuration of my present invention.

Referring to the drawings, wherein like reference numerals indicate like parts, various views of multiple embodiments are shown.

Referring first to FIGS. 1 to 5, a first embodiment is shown which illustrates the basic structure of the receptacle of my invention. The basic container, from which all other embodiments depend, is generally made of sheet steel and includes a rigid rectangular bottom plate, 9, from which the 4 sides upwardly extend. Front plate wall, 14; rear plate wall, 15; left side wall, 16; and right side wall, 10; all join each other as shown to form an open topped container, and may be constructed by any mechanical expedient such as by welding, bending, forming or bolting or any combination thereof.

Fixedly attached to each side plate, 10 and 14, is a pickup sleeve, 18, which is configured to receive a pickup fork, B. Front and rear plates, 14 and 15, are of a uniform width to permit the pickup arms, A, of a standard dumpster vehicle to be inserted into pickup sleeve, 18, so that dumpster truck, G, (FIG. 10) can lift the assembled receptacle for dumping, as hereinafter described. Pickup sleeves, 18, may be fixedly attached to the side walls by any conventional means such as bolts, 11.

Fixedly attached to the exterior face of bottom plate, 9, are right and left support feet, 12 and 13, which keep the bottom plate 9 suspended above support surface, P. Support feet, 12 and 13, are made of any suitable material such as angle iron stock or channel stock and may be comprised of multiple elements such as shorter segments of stock material.

Figure 4:
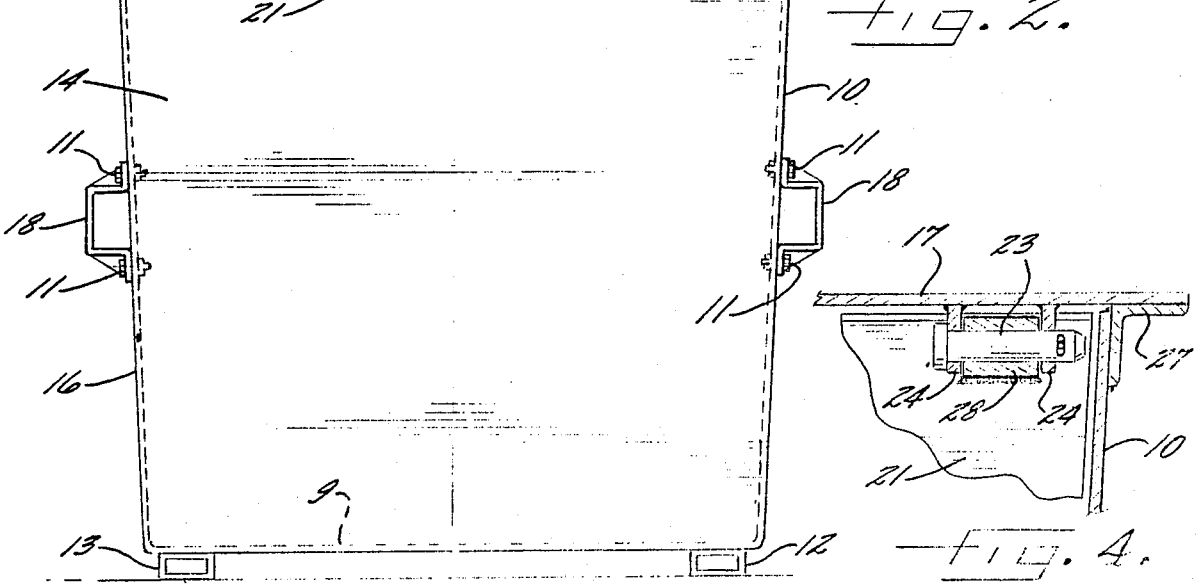
FIG. 4 is a detail view taken along section 4—4 of FIG. 1.
Figure 23:
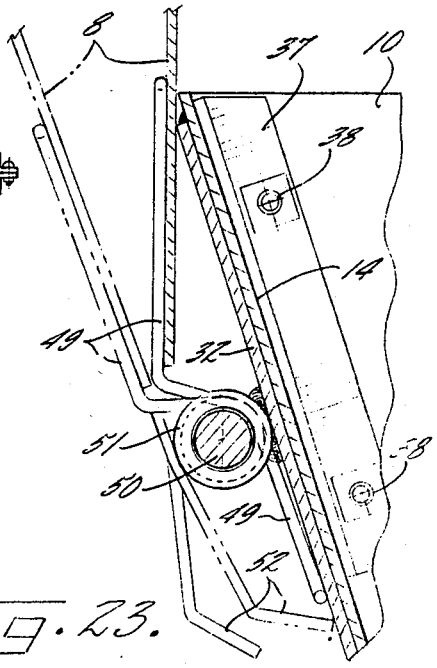
FIG. 23 is a detail view taken along section 23—23 of FIG. 22.

Welded, bolted, or otherwise fixedly attached along the entire length of the upper edges of right side wall, 10, and left side wall, 16, are angle iron brackets, 27, which are so disposed that one leg of the bracket, 17 is affixed to the top of the side wall and the other leg is disposed flush with the top edge of said side wall and protruding at a right angle away from said side wall as shown in FIGS. 23, 4, and 5. Brackets, 27, form a transverse lip along the upper edge of the side walls 10 and 16 upon which moveable top lid, 17, may rest while in the closed position. Moveable top lid, 17, is of such dimension as to cover the entire distance between side walls 10 and 16. Movable top lid, 17, pivots along its rearward edge trough top lid hinge, 30, which is located between rear plate wall, 15, and front plate wall, 14. Movement of top lid, 17, may be facilitated by means of any mechanical expedient such as handle, 26.

As shown in FIGS. 1 and 5, one leaf, 56, of hinge, 30, is fixedly attached to the forward most top edge stationary top member, 19, which is of such dimension as to extend the entire distance between side walls 10 and 16, with sufficient overlap so as to rest on support angles, 27. Stationary top member, 19, extends from the top of rear plate wall, 15, to a point intermediate between rear plate wall, 15, and front plate wall, 14. Stationary top, 19, is held to support angles 27 by bolts, 20. Top lid hinge, 30, is secured to stationary top, 19, by means of mounting bolts, 31. Top lid hinge, 30 is also connected to moveable top lid, 17, thus permitting moveable top lid, 17, to pivot from its normal closed position to an opened position, L, along path Q as shown on FIG. 1.

Front wall, 14, and rear wall, 15, are of sufficiently shorter dimension than side walls, 10 and 16 to permit opening between the moveable top lid, 17, when in the closed position and the top of front wall, 14, and between stationary top, 19, and the top of rear wall, 15. Said openings may be selectively closed by means of hinged doors, 21 and 22.

Front door, 21, is pivoted about multiple hinge pivot pins, 23, which are mounted in any convenient manner such as by bushings, 24, most clearly shown in FIG. 4. Bushings 24 in the preferred embodiment are mounted to front door, 21, by means of mounting hubs, 28. In order to limit the opening created by front door 21 when it is in the closed position, chain 25 may be adjusted to permit either a full closed position or a partially closed position. When front door, 21, is moved to the open position through path, K, access to the interior of the receptacle is provided.

Likewise, rear door, 22, is hinged and caused to move into an open position, shown at J in FIG. 1; which is facilitated by handle, 29.

Figure 11:
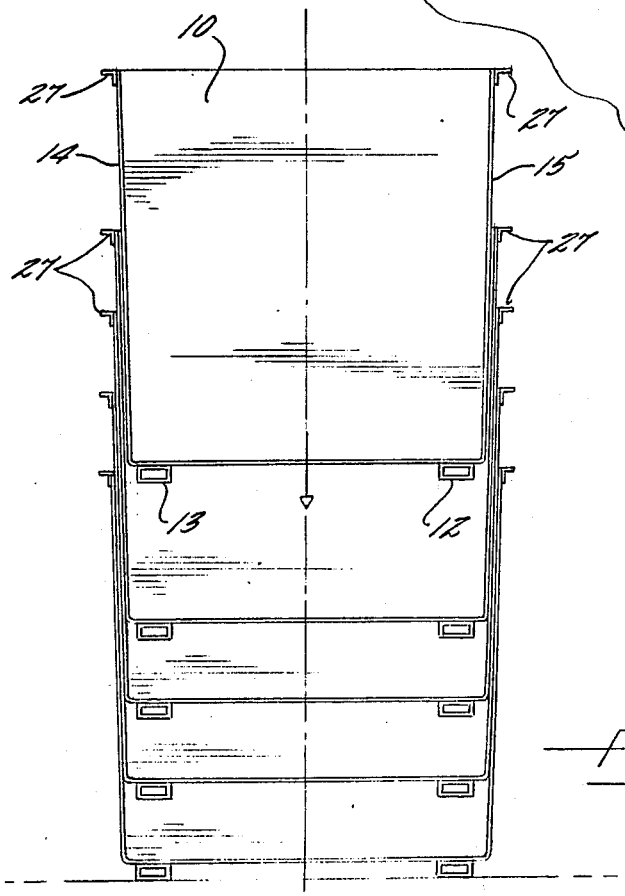
FIG. 11 is a graphic view of the standard body configuration of the first embodiment of my present invention illustrating the stackability feature of my invention.

Side walls 10 and 16 are tapered to facilitate cleaning, emptying and stacking of the basic receptacle component as shown in FIG. 11. Right side wall, 10, is dimensioned to form a tapered angle over 90 degrees from the bottom of right side wall, 10, to the top of right side wall, 10; while the rear wall taper, shown at C in FIG. 1 is slightly tapered at approximately 95 degrees.

Figure 12:
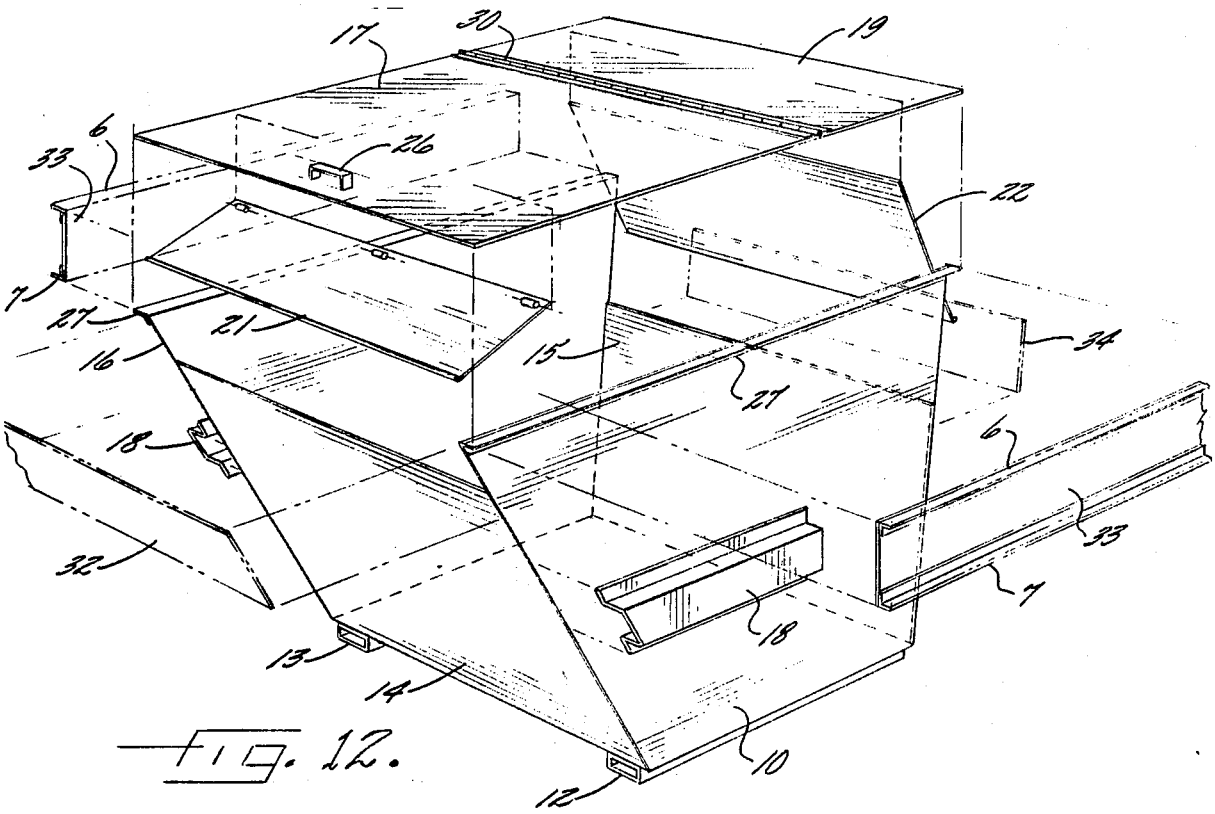
FIG. 12 is an exploded perspective of the extension element of the second embodiment as they may be added to the standard body configuration of the first embodiment of my invention.

In a second embodiment, the basic receptacle, which is the subject of this invention, may be enlarged in volume by more than 20 to 50 percent by means of adding extension members which may be bolted to the top edge of side, rear and front members along the top surface of angle, 27. Once the existing top assembly is removed, side extension member, 33, as shown in FIGS. 6, 9 and 12 are provided with side extension angles, 7 which are fixedly attached to the bottom edge of side extension members 33 by any convenient means such as bolting or welding. Side extension angles, 7, are disposed so that the protruding leg of angle 7, rests upon top lid support angle, 27. Side extension members, 33, are thence removeably attached to the top of side walls 10 and 16 my means of any mechanical expedient, such as bolts, 35; thus extending the vertical dimension of side walls, 10 and 16 by the same height of said extension members, 33, as shown in FIG. 9. Along the top edges of side extension members, 33, are fixedly attached lid support angles, 6 in the same manner that support angles 27 were attached to the top of side walls 10 and 16, in order to support the same top assembly as previously described in the basic embodiment.

In addition, front extension members, 32, as shown in FIGS. 6 and 7, are secured to front wall, 14, by means of bolts, 38, which releaseably attach to the top of plate wall, 14, and pass through extension angle, 37, which is fixedly attached to each end of front extension member 32 such that the extended leg of angle 37 may be bolted to side plate walls, 10 and 16 by means of bolts, 38. Likewise, rear wall, 15 is extended by means of rear extension member, 34, which is releaseably attached by means of bolts, 36, passing through extension angles, 39, fixedly attached to each side of extension member, 32. Rear extension member, 34, may then be bolted to side plate walls, 10 and 16 by means of fasteners, 36.

Extension members 32, 33, and 34 are dimensioned, so as to uniformly increase the vertical dimension of the basic receptacle so that the top assembly may be utilized on both the basic receptacle assembly and that of the expanded embodiment. In addition, front door, 21, may also be provided with handle, 54, to facilitate its opening.

Certain increases in receptacle volume by use of extension members, 32, 33, and 34, may require replacement of front door 21, by a replacement door, 8, as shown in FIG. 12 which may be replaced by use of the same hinge assembly detailed in FIG. 4

Figure 10:
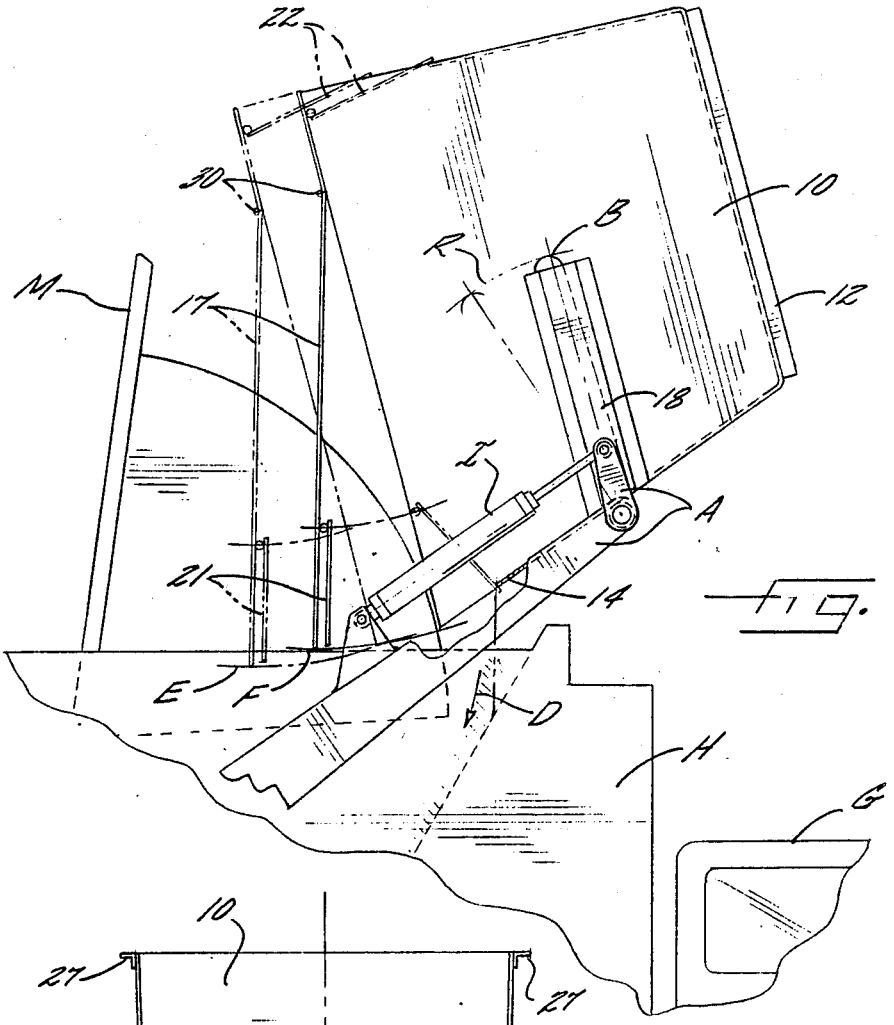

As shown in FIG. 10, truck, G, lifts the receptacle by means of pickup fork, B, which is lifted by means of hydraulic cylinder, I, over trailer/compactor, H, while compactor lid, M, is opened. Moveable top lid, 17, and front door, 21 are then caused by gravity to open for discharge of the refuse in the receptacle into compactor, H, through dump path, D. While the basic receptacle assembly may be lifted through the dump path shown by paths, E and R, a slightly more shallow path as depicted by F, may be required when extension members, 32, 33, and 34, are used.

Figure 13:
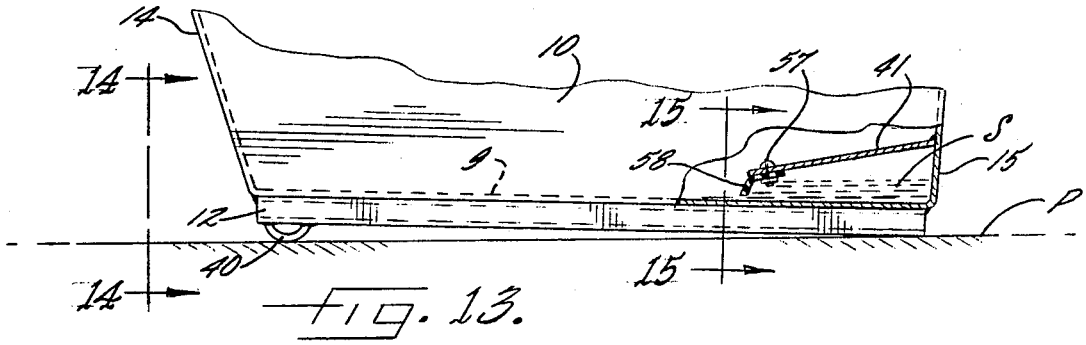
FIG. 13 is a right side detail section of the bottom portion of my present invention.
Figure 14:
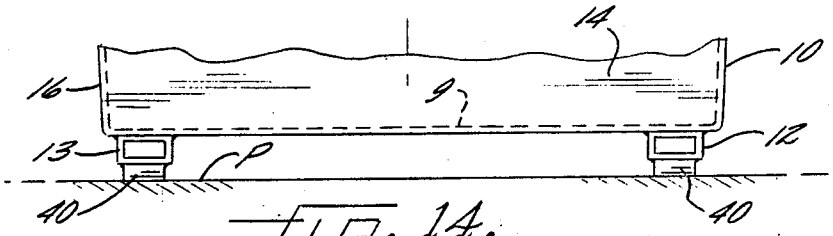
FIG. 14 is a detail view taken along section 14—14 of FIG. 13 showing the front bottom portion of my present invention.
Figure 15:
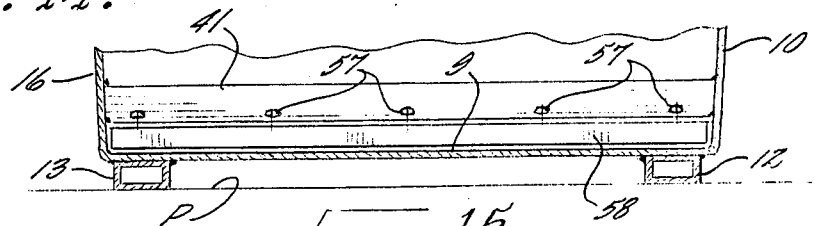
FIG. 15 is a detail view taken along section 15—15 of FIG. 13 showing the drain located in the rear bottom of my present invention.

Referring now to FIGS. 13, 14, and 15, a supplemental riser element, 40, is shown under the front end of support feet 12 and 13, which serve to slightly tilt the receptacle relative to support surface P, so that any liquid components, S, which may have settled to the bottom plate, 9, of the receptacle may be collected at the rear of the receptacle. To facilitate the separation of any liquid component, S, from the solid refuse in order to give special treatment to the liquid, S, or to diminish the obvious adverse effects of integrating liquid and solid refuse, a liquid trap is provided by means of drain cover, 41 fixedly attached to the lower portion of the interior surface of rear wall, 15, and extending forward toward front wall, 14. Drain cover, 41, is provided with deflector strip, 58, which allows liquid drainage, S, to be collected therebeneath. Liquid, S, is also trapped beneath the drain cover, 41, by means of defector strip, 58, which is releaseably attached to drain cover, 41 by means of bolts, 57.

FIGS. 16, 17, 18, 19, 20 21, 22, 23, and 24 depict a third embodiment of my invention where the basic receptacle unit described as my first embodiment is increased in size by the addition of side extension elements, 43, which form a wide mouth top loading dumping receptacle. Side extension elements, 43, like side extension member, 33, of my second embodiment are provided with extension angles, 7, affixed to the bottom edges thereof for releaseably fastening to support angle, 27 by means of bolts, 35. Extension element, 43, like extension members, 33, provide rear and front vertical edges which protrude perpendicularly to the bottom edge where angle, 7, is affixed, rather than protruding at angles parallel to the tapered walls of the basic receptacle unit. In addition, front vertical wall edge, 100 is of a greater dimension than rear vertical wall edge, 102, creating a trapezoidal planar shape for the surface of side extension element, 43. Extending between the forward top edge of side extension elements, 43, is fixedly attached a support angle, 44, for rigidity and support.

Figure 16:
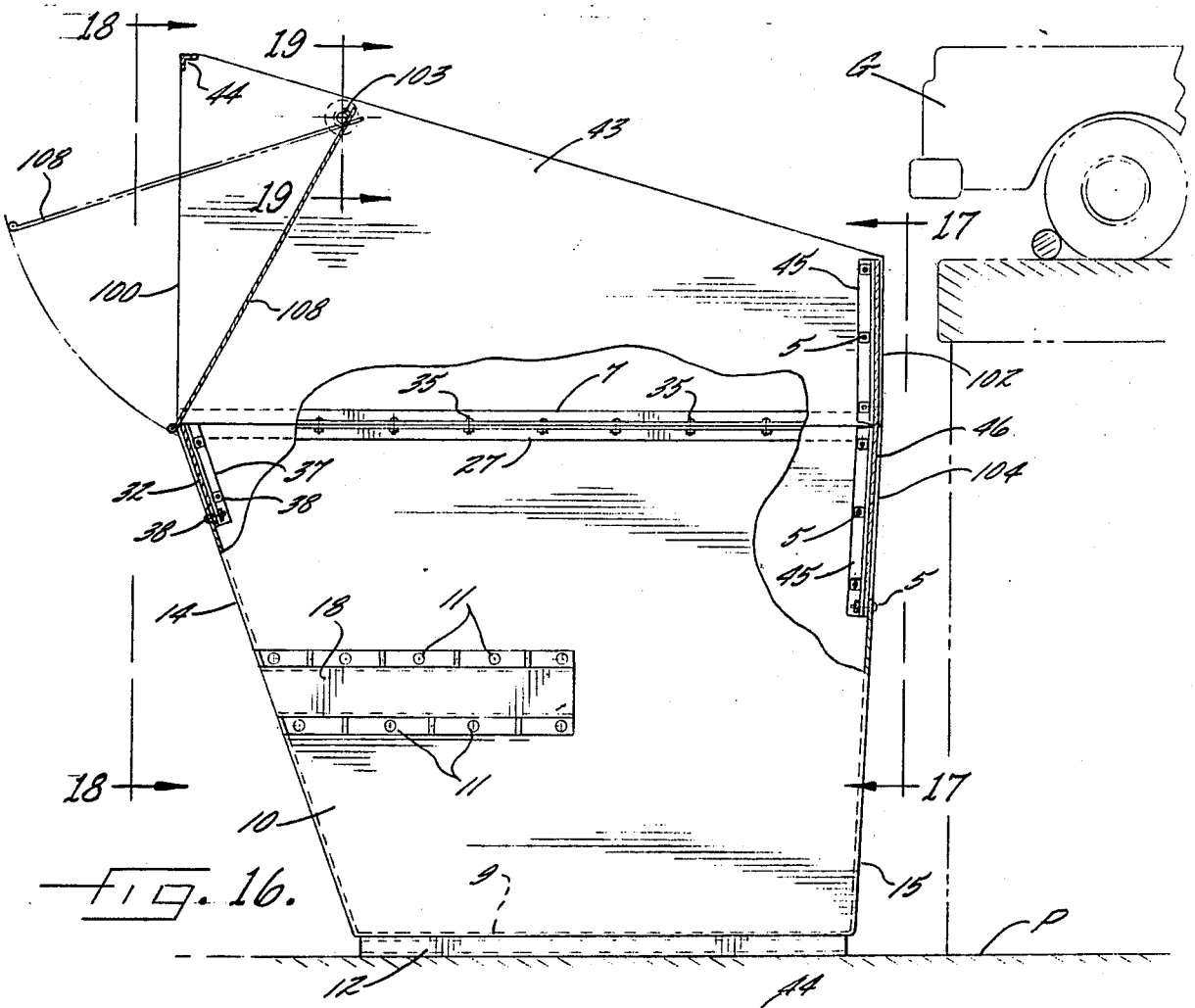
FIG. 16 is a right side elevational view of the third embodiment of my invention showing a top loader container.
Figure 17:
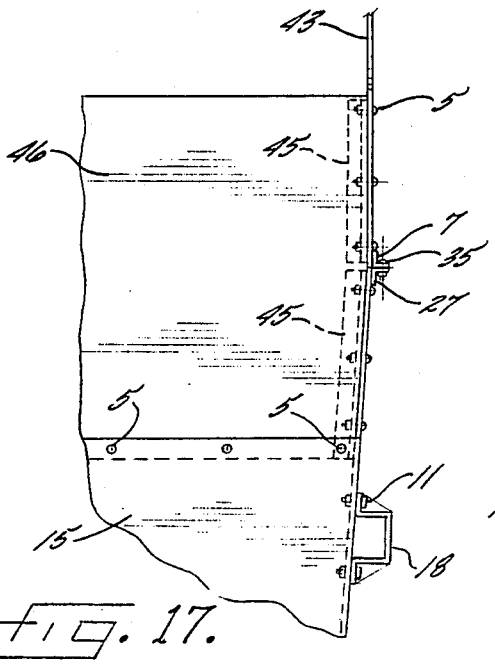
FIG. 17 is a detail view taken along section 17—17 FIG. 16.
Figure 18:
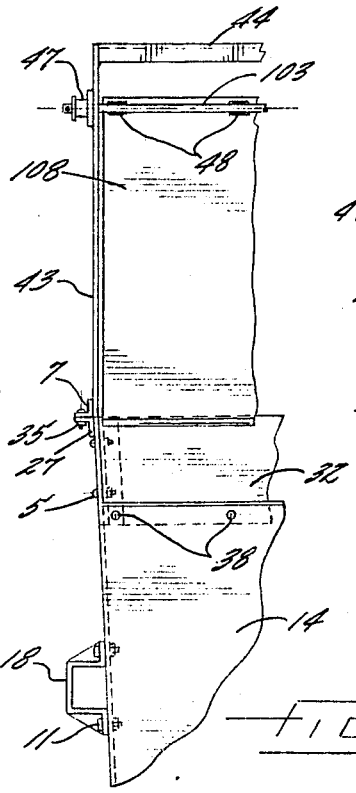
FIG. 18 is a detail view taken along section 18—18 of FIG. 16.
Figure 19:
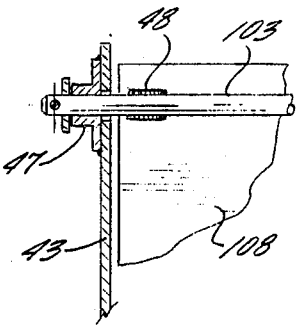
FIG. 19 is a detail view taken along section 19—19 of FIG. 16.

In my third embodiment, as in my second embodiment, front extension member, 32, is releaseably attached to the front plate wall, 14 in order to increase the forward wall dimension of the basic receptacle, leaving an opening between the top edge of front extension member, 32 and support angle, 44; said opening being selectively closed by replacement door, 108. Door, 108, is pivoted about pin, 103, which passes through side extension elements, 43, as shown in FIG. 16. As further detailed in FIG. 8 and FIG. 19, pin 103 is journaled at each end in bearing 47 and guides, 48.

A rear extension element, 46, is bolted along its lower edge to rear plate wall, 15, by means of bolts, 5, along each side of rear extension element, 46, are extension angles, 45, which permit the rear extension element, 46, to be bolted to side plate walls, 10 and 16 and to side extension element, 43 as shown in FIGS. 16 an 17.

Figure 20:
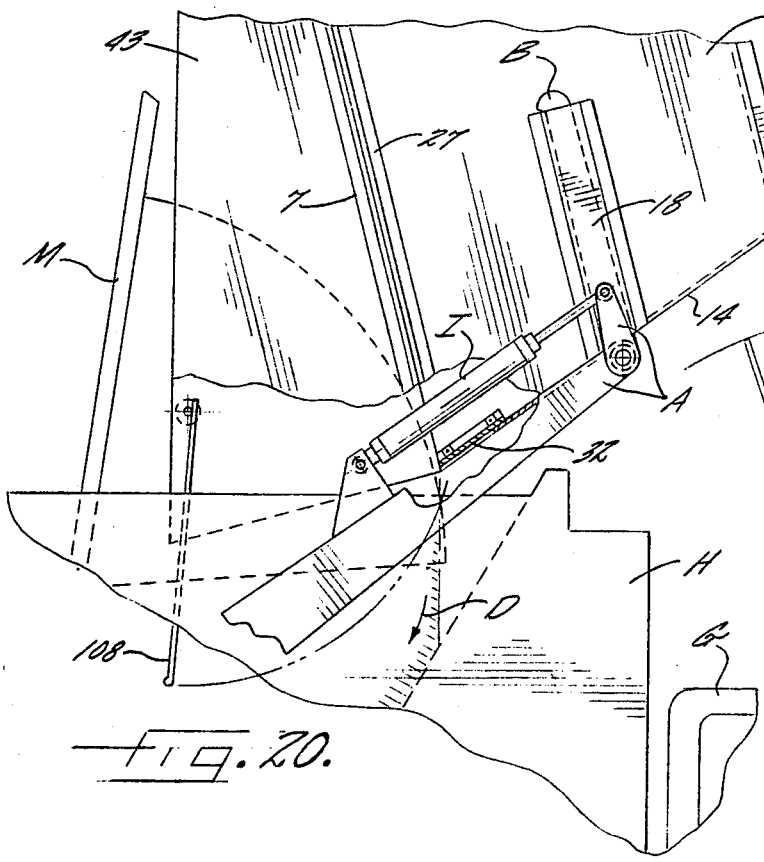
FIG. 20 is a side elevational view of the third embodiment of my present invention depicting a top loader container in the dump position into a compactor.
Figure 21:
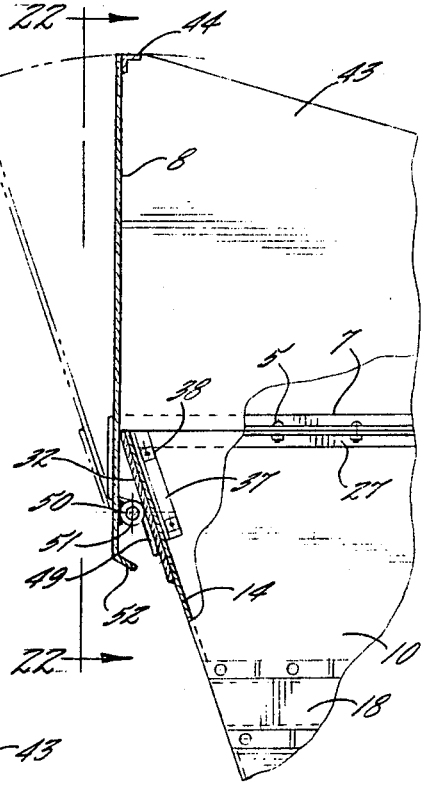
FIG. 21 is a detail view of the third embodiment of my present invention depicting a spring biased top loading container with hinges along the bottom of the front door.
Figure 22:
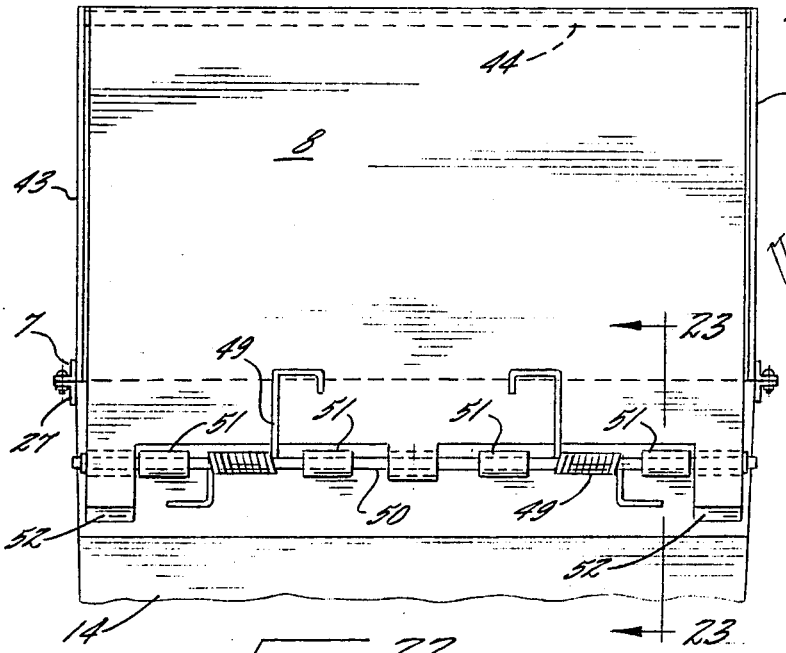
FIG. 22 is a detail view taken along section 22—22 of FIG. 21.

As may be seen in FIG. 20, the top loader, wide mouth receptacle, created by extension elements 43 and 46 may be dumped by the conventional hydraulic dumpster equipment in a cleaner, more efficient fashion, leaving more room in the interior hopper, H, since the top loaded receptacle remains essentially outside of hopper, H, during the dumping process.

Figure 24:
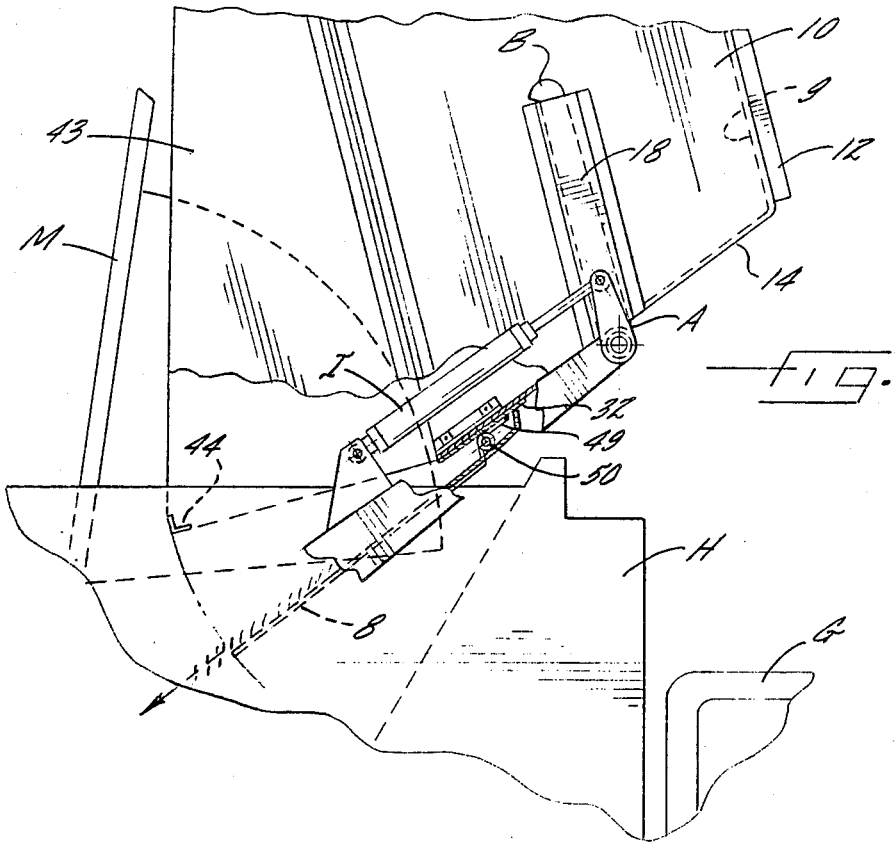
FIG. 24 is a side elevational view of the third embodiment of my present invention showing the dump position for a front door hinged along the bottom of the front door.
Figure 25:
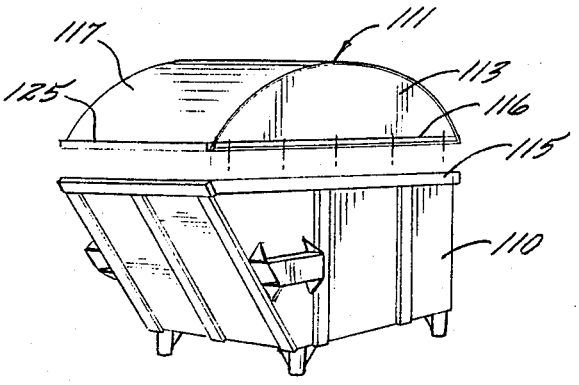
FIG. 25 is a perspective view of a fourth embodiment of my present invention showing curved side extension members and curved top.

FIGS. 21, 22, 23, and 24 depict an improved embodiment of supplemental door assembly 8, by the addition of a spring biased pivot along the bottom edge of door 8, permitting the door to be opened from the top, rather than from the bottom. Pivot rod, 50, is journaled at each end along and intermediate the side edges of door, 8, in pivot rod bushings, 51. In order to maintain door 8 in a closed position against the force of gravity, tending to pull the door, ,, open, is spring assembly, 49, attached to front extension member, 32, as shown in FIG. 23. Door 8 extends below spring assembly, 49, and is provided with an angular protrusion, 52, which serves as a limit to prevent door, 8, from opening beyond a predesigned angle. FIG. 24 illustrates the function of spring loaded door 8 during the dumping action previously described.

Looking now at FIGS. 25, 26, 27, and 28, I have disclosed yet another embodiment which is designed to increase the volume of conventional dumpster containers, 110. An expansion top assembly, shown generally at 111 is removeably attached to the top edge o container, 110, by bolts, 112, as previously disclosed in the other embodiments hereof.

Expansion top assembly, 111, is constructed as a unit and includes two sides, 113 and 114, which are identical and of such length along its bottom edge as to match the top edges of the side members of container 110. Of course, container, 110 as disclosed in the preceding embodiments includes a support member around the top perimeter of the basic container, 110, which support member having been described as an angle in previous embodiments, but which may be of any support cross-section such as a channel member, as disclosed in this embodiment as 115. Fixedly attached along the bottom edge of each side member, 113 and 114 are angle members, 116 which allow the top unit, 111 to be secured to the top of container, 110.

Figure 28:
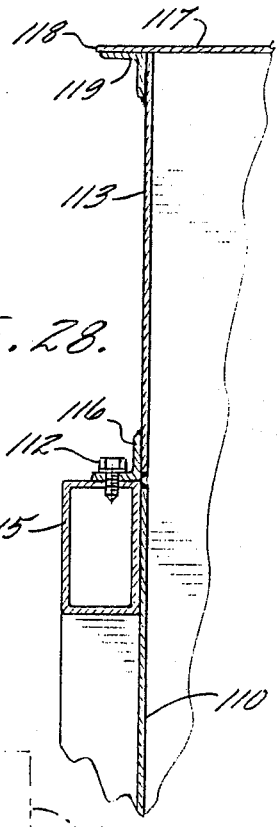
FIG. 28 is a detail view taken along lines 28—28 of FIG. 27.
Figure 26:
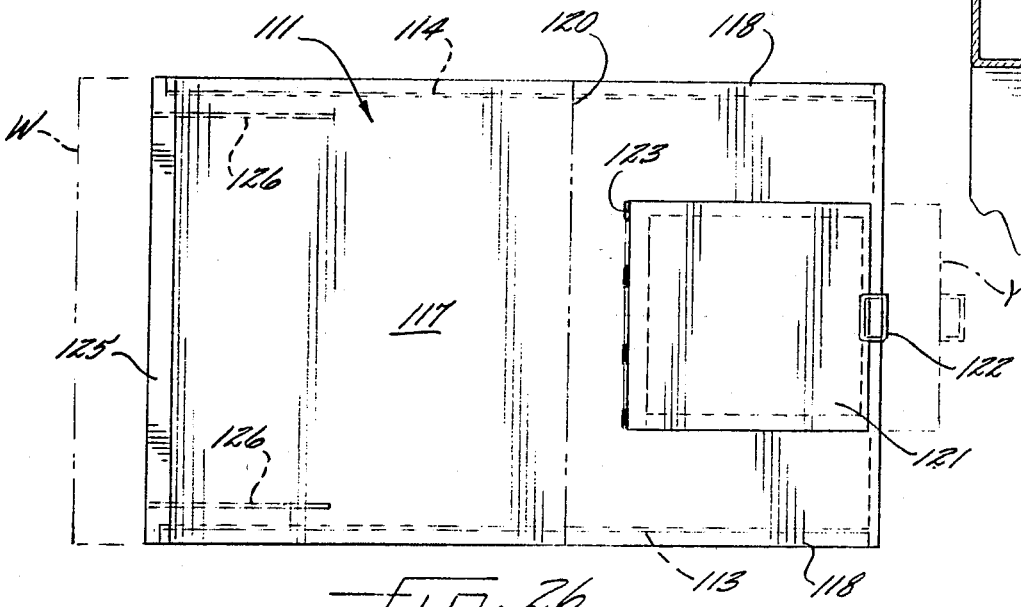
FIG. 26 is a top view of the fourth embodiment shown in FIG. 25.

The top edge of side members, 113 and 114 is curved its entire length as shown, making the perimeter of each side member, 113 and 114 an arc. Top surface, 117, may be constructed of a unitized sheet of suitable material, such as steel which is affixed to the top edge of side members, 113 and 114, by any expedient, such as welding and being of such oversized dimension as to allow a relatively small overhang, 118, around the perimeter of top unit, 111, as shown in FIGS. 26 and 28. Angle members, 119, are affixed for support under the overhang, 118, with one leg affixed to top, 117, and the other leg of the angle, 119, being affixed to side members, 113 and 114.

Figure 27:
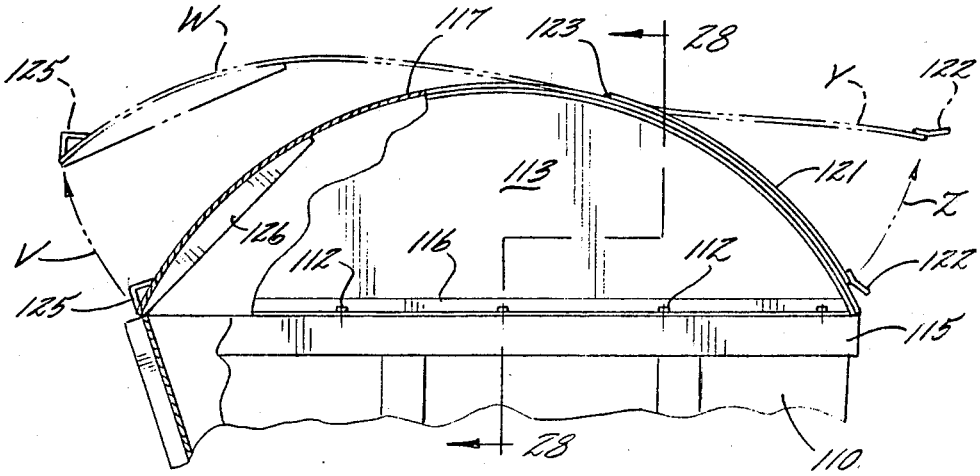
FIG. 27 is a side view detail of the extension member of the fourth embodiment of my invention.

Located along the rear portion of top surface, 117, may be located an access door, 121, hinged at, 123 so that it may be selectively opened from the rear for access to deposit refuse into container, 110. Handle, 122, may be provided to facilitate opening as shown in FIGS. 26 and 27. Door 121, may then be opened as shown by phantom lines, Y, in FIGS. 26 and 27 along path, Z, and is biased in a closed position by gravity.

Top surface, 117, may be welded to the top horizontal leg of angle 119, from the end where door 121 is located to any intermediate point such as that shown at 120; the remaining edge of top surface 117 not being fastened permanently to the top horizontal leg of angle, 119, but resting on angle, 119, so that it may be lifted along path, V, to an open position as shown by phantom lines, W, in FIGS. 26 and 27 In order to maintain its natural curvature when lifted, brace,, 126, are provided as shown in FIGS. 26 and 27 and handle, 125, may also be provided to facilitate manual opening. The line shown in FIG. 26 at 120, separating the fastened from the free portions of top surface, 117, become a hinge line when the free portion of top surface 117 is lifted along path, V. When the embodiment illustrated in FIGS. 25, 26, 27, and 28, is dumped as disclosed by previous embodiments, the free portion of top surface, 117 drops open by the force of gravity to permit discharge of refuse within container, 110.

It should be apparent that an improved refuse collection device has been described. While the invention has been shown in multiple embodiments, many other modifications, changes and substitutions in detailed construction and combination, and arrangements of elements may be employed without departing from the spirit and scope of the invention.

I claim:

1. An improved receptacle for refuse comprising:
(a) an open-top rigid container with flat bottom and extending upward therefrom, 2 tapered sides, a tapered front and tapered back;
(b) sleeves removeably secured to opposite sides positioned and sized to accommodate the standard pick up arms of the hydraulic pickup assembly of a dumpster vehicle;
(c) A removeable partial top secured intermediate between the top of a pair of opposite sides and extending intermediate the said front and back leaving a top opening adjacent the front and a top opening adjacent the back;
(d) Angle iron segments secured along the top edges of opposite sides having one leg of the angle iron protruding outwardly at a 90 degree angle away from and flush with the top edge of said opposite sides.

2. The receptacle of claim 1 wherein the said back and front extend upward from said bottom a shorter distance than do said sides.

3. The receptacle of claim 2 wherein a moveable lid is pivoted along the trailing edge of said partial top so that the lid extends from said trailing edge to the top of said back, to form a closure which may be caused to pivot along the said trailing edge to open or close said top opening adjacent to the back.

4. The receptacle of claims 2 or 4, wherein a moveable lid is pivoted along the leading edge of said partial top so that the lid extends from said leading edge to the top of said front, to form a closure which may be caused to pivot along the said leading edge to open or close said top opening adjacent to the front.

5. The receptacle of claim 4 wherein a riser element is secured under the front portion of said feet in order to tilt the receptacle slightly backward.

6. The receptacle of claim 2 wherein the receptacle is supported by feet which lift the said bottom from direct contact with any surface upon which said receptacle is placed.

7. The receptacle of claim 6 wherein a liquid trap is provided along the intersection of the back and bottom surfaces of the interior of said receptacle, said trap being comprised of a cover element which separates solid refuse within the receptacle from accumulated liquid trapped therebeneath and a deflector element along the forward edge of said cover element which extends vertically to slight contact with the bottom surface of the receptacle to permit liquid to pass under the deflector to be held separate from the solid refuse.

8. The receptacle of claim 7 wherein the said back and front extend upward from said bottom a shorter distance than do said sides.

9. A receptacle for refuse comprising:
(a) an open-top rigid container with flat bottom and extending upward therefrom, 2 tapered sides, a tapered front and tapered back;
(b) sleeves removeably secured to opposite sides positioned and sized to accommodate the standard pick up arms of the hydraulic pickup assembly of a dumpster vehicle;
(c) Angle iron segments secured along the top edges of opposite sides, front and back, having one leg of the angle iron protruding outwardly at a 90 degree angle away from and flush with the top edge of said opposite sides.
(d) Side extention members, releaseably secured to said angle iron segments, which serve to increase the vertical dimension of the said sides, front and back.
(e) Angle iron segments secured along the top edge of opposite sides of extension members having one leg of the angle iron protruding outwardly at a 90 degree angle away from and flush with the top edge of said opposite sides.

(f) A removeable partial top secured intermediate between the top of the sides and extending intermediate the said front and back leaving a top opening adjacent the front and a top opening adjacent the back.

10. The receptacle of claim 9, wherein a moveable lid is pivoted along the leading edge of said partial top so that the lid extends from said trailing edge to the top of said back, to form a closure which may be caused to pivot along the said trailing edge to open or close said top opening adjacent to the back.

11. The receptacle of claims 12 or 8 wherein a moveable lid is pivoted along the leading edge of said partial top so that the lid extends from said leading edge along and resting upon the top surface of said angle iron segment secured along the top edges of said extension members to form a partial closure which may be caused to pivot along said leading edge to open and close the forward top opening but still leaving an opening between the front edge of said lid and the top edge of said front extension element; even when said lid is in the closed position.

12. The receptacle of claim 11 wherein the side extension members extend along its rear edge the same vertical dimension as the upper section of the back extension member and the front edge of said side extension member extends upward a dimension in excess of the dimension of the rear edge.

13. The receptacle of claim 11 wherein a second front lid is pivotally attached to the top lid along a pivot line between the sides of said top lid, said line being located intermediate the front and pivotal edges of said top lid and extending to the top edge of front extension member to form a closure which may be caused to pivot along said pivot line to open and close said second opening between the said top lid and the top edge of the front extension member.

14. The receptacle of claim 13 wherein a front lid is pivotally attached to a pivot pin along a pivot line between the extension side members to form a closure which may be caused to pivot line to open and close said opening between the said pivot pin and the top edge of the front extension member.

15. The receptacle of claim 13 wherein a support angle is secured between the top front corners of side extension members.

16. A receptacle for refuse comprising:

(a) an open-top rigid container with flat bottom and extending upward therefrom, 2 tapered sides, a tapered front and tapered back;

(b) sleeves removeably secured to opposite sides positioned and sized to accommodate the standard pick up arms of the hydraulic pickup assembly of a dumpster vehicle;

(c) Angle iron segments secured along the top edges of opposite sides, front and back having one leg of the angle iron protruding outwardly at a 90 degree angle away from and flush with the top edge of said opposite sides.

(d) side extension members, releaseably secured to said angle iron segments, which serve to increase the vertical dimension of the said sides.

(e) Front extension member of such dimension so as to bring the top edge of said front extension member to the same vertical elevation as side members; and (f) Back extension member comprised of an upper and lower section, the lower section being of such dimension so as to increase the back side to the same vertical elevation as side members and the upper section extends upward from the top of said lower section at a 90 angle to the support surface upon which the recepticle rests.

17. A receptacle of claim 16 wherein said back extends upward from said bottom a shorter distance than do said sides.

18. The receptacle of claim 17 wherein a front lid is pivotally attached to a pivot pin located along the front surface of front extension member and extending the entire width of said front extension member, said front lid extending upwardly from said pivot pin to said support angle forming a closure which may be caused to pivot along said pivot pin to open and close said opening between the top edge of front extension member and said support angle.

19. The receptacle of claim 17, the said front lid is held in a closed position by means of mechanical springs.

* * * * *